US005902223A

United States Patent [19]

Simmons

[11] Patent Number: 5,902,223

[45] Date of Patent: May 11, 1999

[54] CUSHONING CONVERSION MACHINE

[75] Inventor: James A. Simmons, Painesville Township, Ohio

[73] Assignee: Ranpak Corp., Concord Township, Ohio

[21] Appl. No.: 08/725,031

[22] Filed: Oct. 2, 1996

Related U.S. Application Data

[60] Provisional application No. 60/004,886, Oct. 6, 1995.

[51] Int. Cl.[6] ..... B31F 1/10

[52] U.S. Cl. ..... 493/464; 493/967

[58] Field of Search ..... 493/464, 967, 493/475, 476, 478, 977

[56] References Cited

U.S. PATENT DOCUMENTS

| | | | |
|---|---|---|---|
| 2,882,802 | 4/1959 | Walker . | |
| 3,836,021 | 9/1974 | McWilliams . | |
| 3,847,132 | 11/1974 | Schatz . | |
| 4,011,668 | 3/1977 | Gunderson . | |
| 4,839,210 | 6/1989 | Komaransky et al. . | |
| 5,084,000 | 1/1992 | Fordyce | 493/468 |
| 5,088,972 | 2/1992 | Parker . | |
| 5,123,889 | 6/1992 | Armington et al. . | |
| 5,487,717 | 1/1996 | Tekavec et al. . | |
| 5,637,071 | 6/1997 | Simmons | 493/464 |
| 5,649,892 | 7/1997 | Auerbach | 493/420 |
| 5,681,255 | 10/1997 | Simmons | 493/464 |

FOREIGN PATENT DOCUMENTS

| | | |
|---|---|---|
| 9514569 | 6/1995 | WIPO . |

*Primary Examiner*—John Sipos
*Assistant Examiner*—Christopher W. Day
*Attorney, Agent, or Firm*—Renner, Otto, Boisselle & Sklar, P.L.L.

[57] ABSTRACT

A cushioning conversion machine for converting a sheet-like stock material into cushioning products is provided. The machine includes an outlet extension which forms a continuous passageway for the cushioning products from the machine outlet to an appropriate exit location. The outlet extension is coupled to the outlet in such a manner that it is selectively adjustable relative to the outlet to provide for a plurality of exit locations for the cushioning products.

20 Claims, 7 Drawing Sheets

CUSHONING CONVERSION MACHINE

RELATED APPLICATIONS

This application is a continuation of U.S. Provisional Application No. 60/004,886, filed on Oct. 6, 1995 and entitled "Cushioning Conversion Machine." The entire disclosure of this earlier application is hereby incorporated herein by reference.

FIELD OF THE INVENTION

The present invention relates generally as indicated to a cushioning conversion machine and, more particularly, to a cushioning conversion machine in which an outlet extension is coupled to the machine's outlet in such a manner that is selectively adjustable relative to the outlet to provide a plurality of exit locations for the cushioning products.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alterative. Paper is biodegradable, recyclable and renewable; making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion machine, such as those disclosed in U.S. Pat. Nos. 4,026,198; 4,085,662; 4,109,040; 4,237,776; 4,557,716; 4,650,456; 4,717,613; 4,750,896; 4,968,291; 5,123,889; and 5,322,477. (These patents are all assigned to the assignee of the present invention and their entire disclosures are hereby incorporated by reference.) Such a cushioning conversion machine converts sheet-like stock material, such as paper in multi-ply form, into low density cushioning products, or pads.

A cushioning conversion machine, such as those disclosed in the above-identified patents, includes a machine frame having an upstream end and a downstream end. ("Upstream" and "downstream" in this context corresponds to the flow of stock material through the machine.) The conversion assembly of such a machine may include a stock supply assembly, a forming assembly, a feed assembly, and a separating assembly, some or all of which are mounted on the machine's frame. During operation of such a cushioning conversion machine, the stock supply assembly supplies the stock material to the forming assembly. The forming assembly causes inward rolling of the lateral edges of the sheet-like stock material to form a three-dimensional strip of dunnage. The feed assembly pulls the stock material from the stock supply assembly and advances it through the forming assembly to form the continuous strip. The dunnage strip then travels downstream to the separating assembly (preferably a cutting assembly) which separates/cuts the coined strip into cushioning products of a desired length.

The cushioning products emerge from the machine's outlet at an appropriate exit location. The appropriate exit location for the cushioning products depends greatly upon the particular packaging situation in which the cushioning conversion machine is employed. For example, if short cushioning products are to be accumulated in a receptacle positioned below the machine outlet, an appropriate exit location would be at low elevation near the receptacle's opening. Alternatively, if longer cushioning products are to be used to package articles situated on a table, an appropriate location would be at higher elevation, adjacent the table's work platform.

In the past, an appropriate exit location has been acquired by adjusting the height of the machine to the desired location. For example, an elevated exit location has been acquired by placing stilts on a self-standing machine which elevate the machine (and thus its outlet) to the appropriate height of the exit location. (See e.g., U.S. patent application Ser. No. 08/155,155.) Also, an appropriate exit location has been obtained by placing a machine on a cart and adjusting the vertical height of the cart (and thus the machine and its outlet opening). Adjustments have additionally been accomplished by using a machine mounting stand in which the machine (and thus its outlet opening) may be vertically and/or angularly adjusted relative to the stand, such as the stand disclosed in U.S. Pat. No. 5,322,477.

While the above-discussed stilts, carts, and/or stands have been successful in establishing an appropriate exit location in many circumstances, they do not address all situations. For example, while stilts are effective in elevating the exit location of the machine, they are unable to lower the exit location. Also, carts have conventionally provided only a limited range of vertical adjustment compatibility. As for machine-mounting stands, they are sometimes incompatible with existing packaging systems because the stands may interfere with other equipment. Moreover, with such stilts, carts and/or stands, providing a plurality of exit locations requires adjustment of the entire machine.

An appropriate exit location has also been accomplished in the past by providing a fixed outlet extension forming a continuous passageway from the machine's outlet to the desired exit location. (See e.g., U.S. patent application Ser. No. 08/155,931, assigned to the assignee of the present invention.) However, such an outlet extension does not provide convenient adjustment to a different exit location in that a different outlet extension would have to be provided for each desired exit location. As such, adjustment of the exit location requires removing the extension and perhaps replacing it with a different extension.

Accordingly, a need remains for a cushioning conversion machine in which the exit location of the cushioning products could be adjusted without adjusting the position of the machine and/or without changing outlet extensions.

SUMMARY OF THE INVENTION

The present invention provides a cushioning conversion machine in which an outlet extension is coupled to the machine's outlet in such a manner that it is adjustable relative to the machine to provide a plurality of exit locations for the cushioning products. In this manner, the exit location may be changed without adjusting the position of the entire machine and/or without the need for different outlet extensions.

More particularly, the present invention provides a cushioning conversion machine comprising a frame, a conversion assembly, a stock supply assembly, a separating assembly, and an outlet extension. The stock supply assembly is positioned upstream of the conversion assembly and supplies the stock material thereto. The conversion assembly is mounted to the frame and converts the sheet-like stock material into a three-dimensional strip of dunnage. The separating assembly is positioned downstream of the conversion assembly and separates the strip of dunnage into cushioning products of a desired length. The cushioning products emerge through the machine's outlet, which is positioned downstream of the separating assembly. The outlet extension extends downstream of the outlet and forms a continuous passageway for the cushioning products from the machine's outlet to an appropriate exit location. The outlet extension is coupled to the outlet in such a manner that it is selectively adjustable relative to the outlet to provide for a plurality of exit locations for the cushioning products.

These and other features of the invention are fully described and particularly pointed out in the claims. The following description and annexed drawings set forth in detail one illustrative embodiment of the invention, this embodiment being indicative of but one of the various ways in which the principles of the invention may be employed.

DETAILED DESCRIPTION

Figure 1:
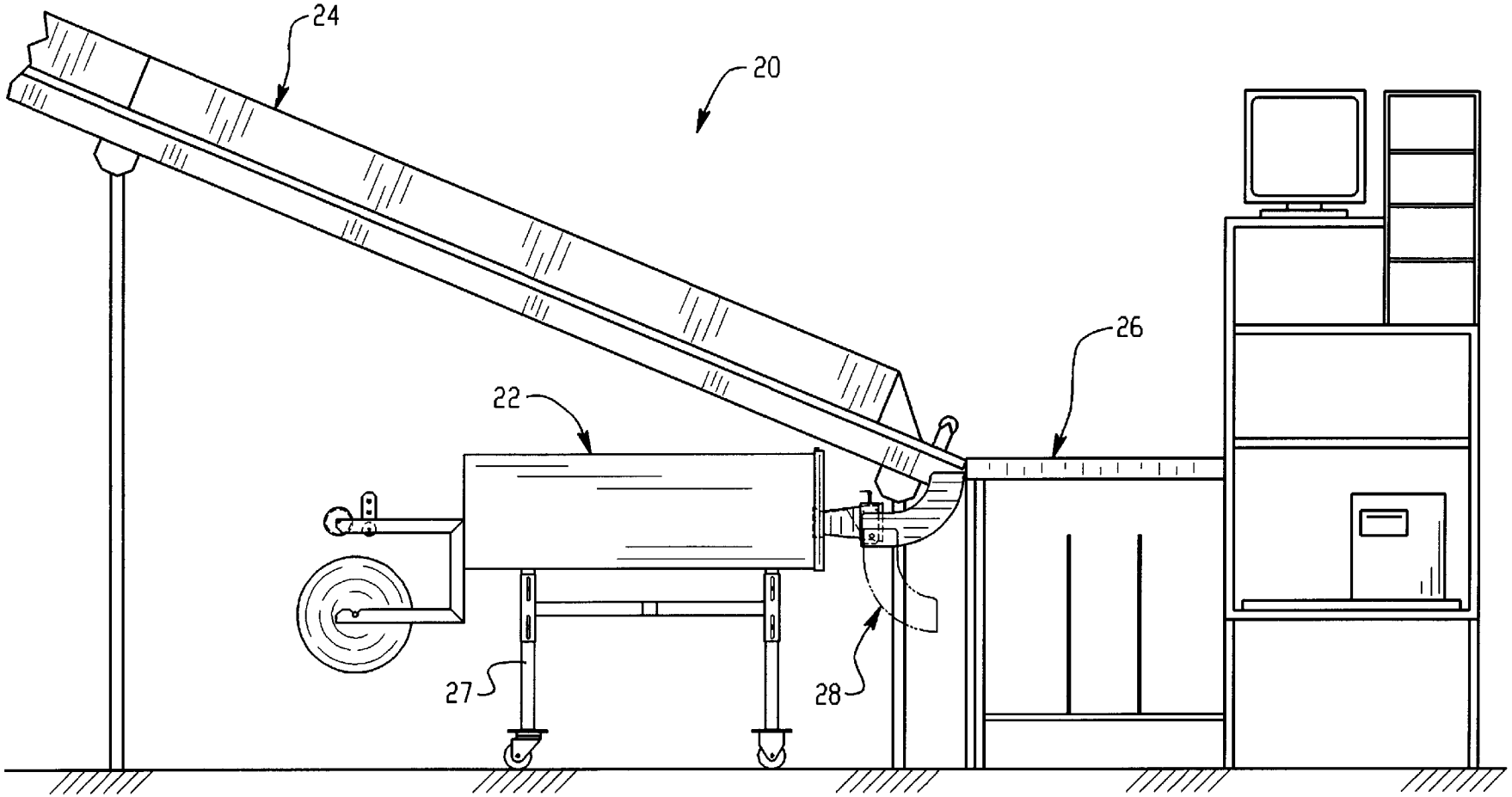
FIG. 1 is a front view of a packaging system incorporating a cushioning conversion machine according to the present invention, the machine including a selectively adjustable outlet extension shown in two alternate positions, the second position being shown in phantom.

Referring now to the drawings in detail and initially to FIG. 1, a packaging system 20 incorporating a cushioning conversion machine 22 according to the present invention is shown. In addition to the cushioning conversion machine 22, the system 20 includes a slanted conveyor 24, a packaging table 26, and a cart 27. As is explained in more detail below, the cushioning conversion machine 22 includes an outlet extension 28 which is selectively adjustable to provide for a plurality of exit locations for the cushioning products. For example, in the upwards position, longer cushioning products would exit onto the packaging table 26. In the downwards position, shorter cushioning products could exit into a receptacle (not shown) for accumulation or otherwise.

It may be noted that slanted conveyor 24 would probably prevent the use of the machine-mounting stand disclosed in U.S. Pat. No. 5,322,477 and/or stilts on a self-standing machine. It may also be noted that while a fixed output extension may be successful in providing a continuous passageway for the cushioning products to the desired exit location on the table top, such an extension would have to be removed/replaced when the desired exit location was at a lower elevation adjacent a receptacle. Additionally, while the illustrated cart could be used to provide some vertical adjustment of the machine (and thus its outlet), its limited adjustment range could not satisfy both an exit location on the table top and a lower exit location.

Figure 2:
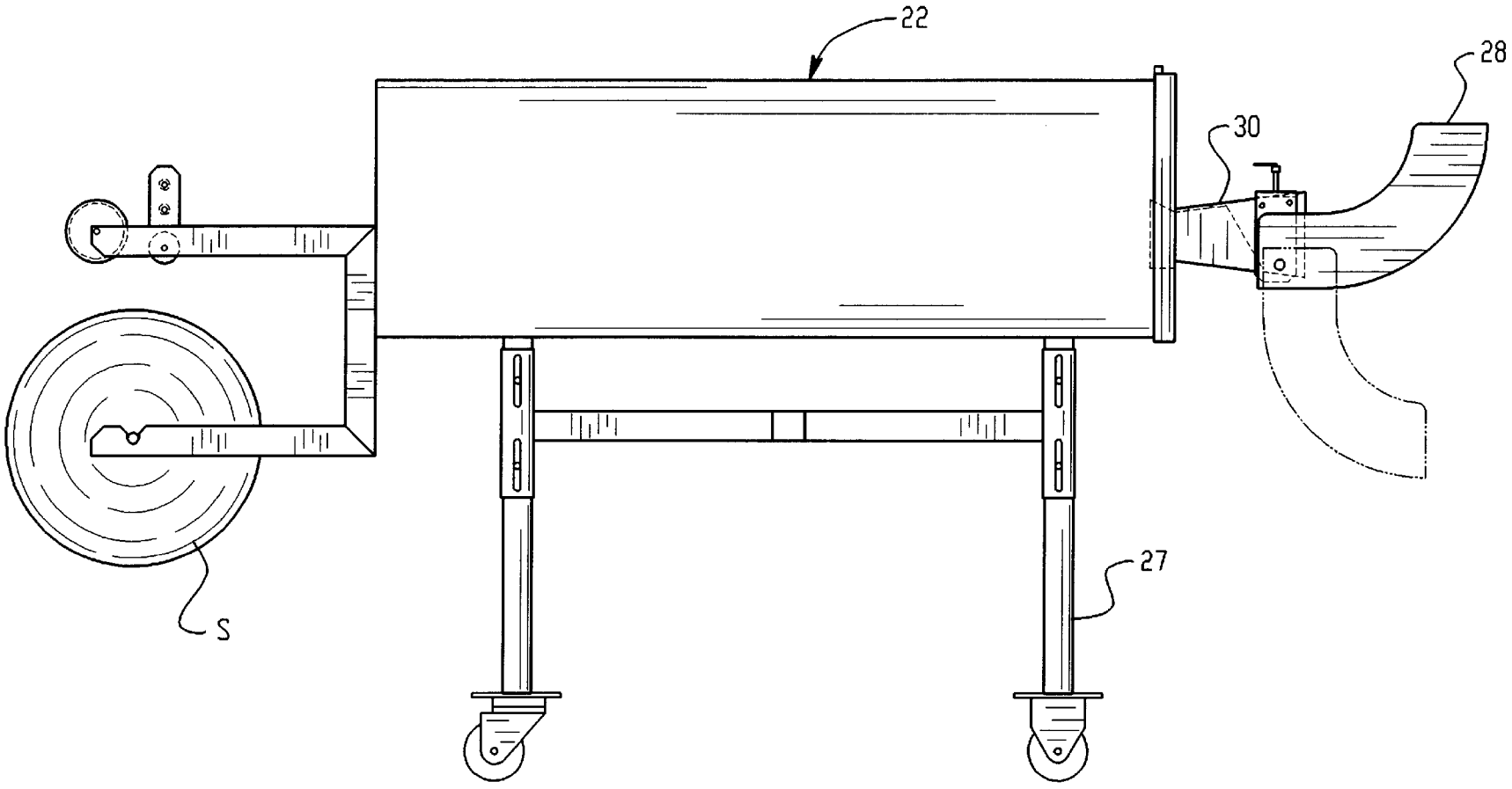
FIG. 2 is a front view of the cushioning conversion machine isolated from the other components of the system, the outlet extension again shown in the two alternate positions, the second position being shown in phantom.

Referring now additionally to FIG. 2, the machine 22 and the cart 27 are shown isolated from the other components of the packaging system 20. As is explained in more detail below, the machine 22 converts a sheet-like stock material S into cushioning products for use in packaging. In the preferred embodiment, the machine 22 converts multiple plies of recyclable and reusable Kraft paper into cushioning products (or pads) having two lateral pillow-like portions separated by a thin central band. A detailed description of such a cushioning product is set forth in U.S. Pat. No. 4,937,131. (This patent is owned by the assignee of the present invention and its entire disclosure is hereby incorporated by reference.)

The cushioning products emerge though the machine's outlet 30 and the outlet extension 28 provides a continuous passageway for the cushioning products from the outlet 30 to an appropriate exit location. The outlet extension 28 is coupled to the machine outlet 30 in such a manner that it is selectively adjustable relative to the machine outlet to provide for a plurality of exit locations for the cushioning products. This arrangement allows the exit location of the cushioning products to be changed without adjusting the position of the entire machine and/or without the need for different outlet extensions.

Figure 3A:
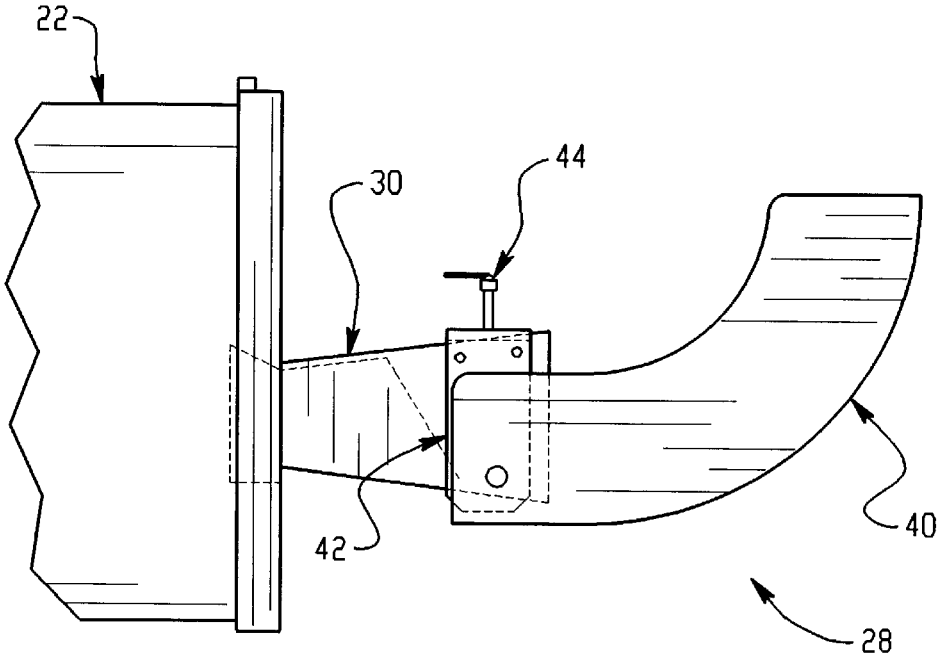
FIGS. 3A and 3B are isolated front views of the outlet extension and adjacent portions of the machine, the outlet extension being shown in the first position in FIG. 3A and in the second position in FIG. 3B.
Figure 3B:
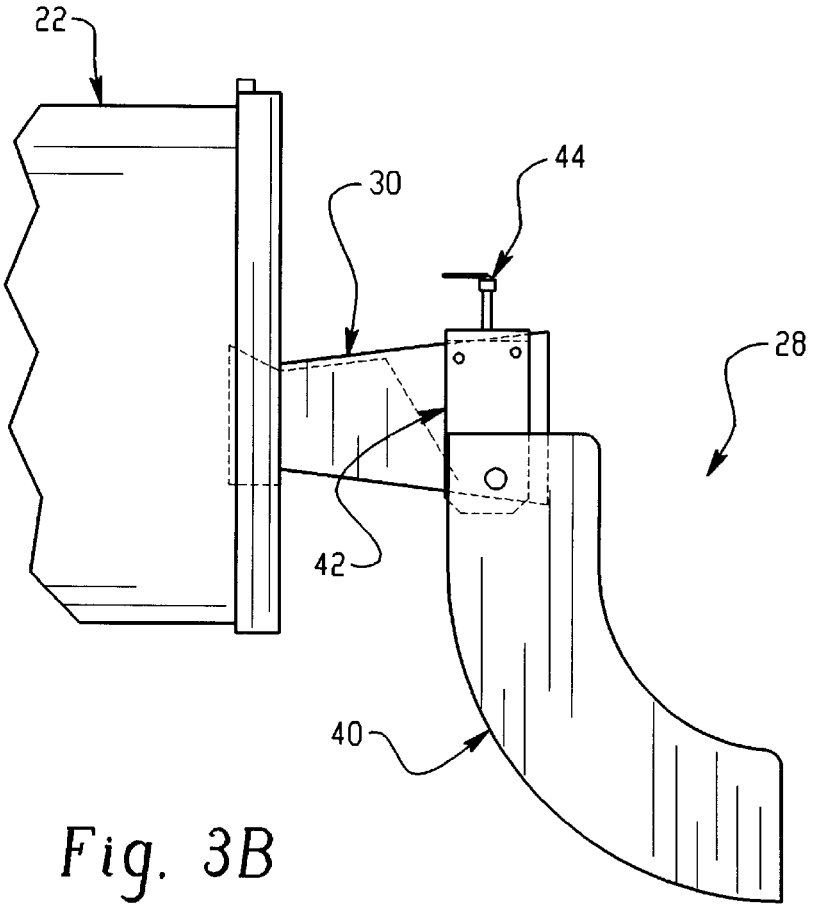
Figure 4:
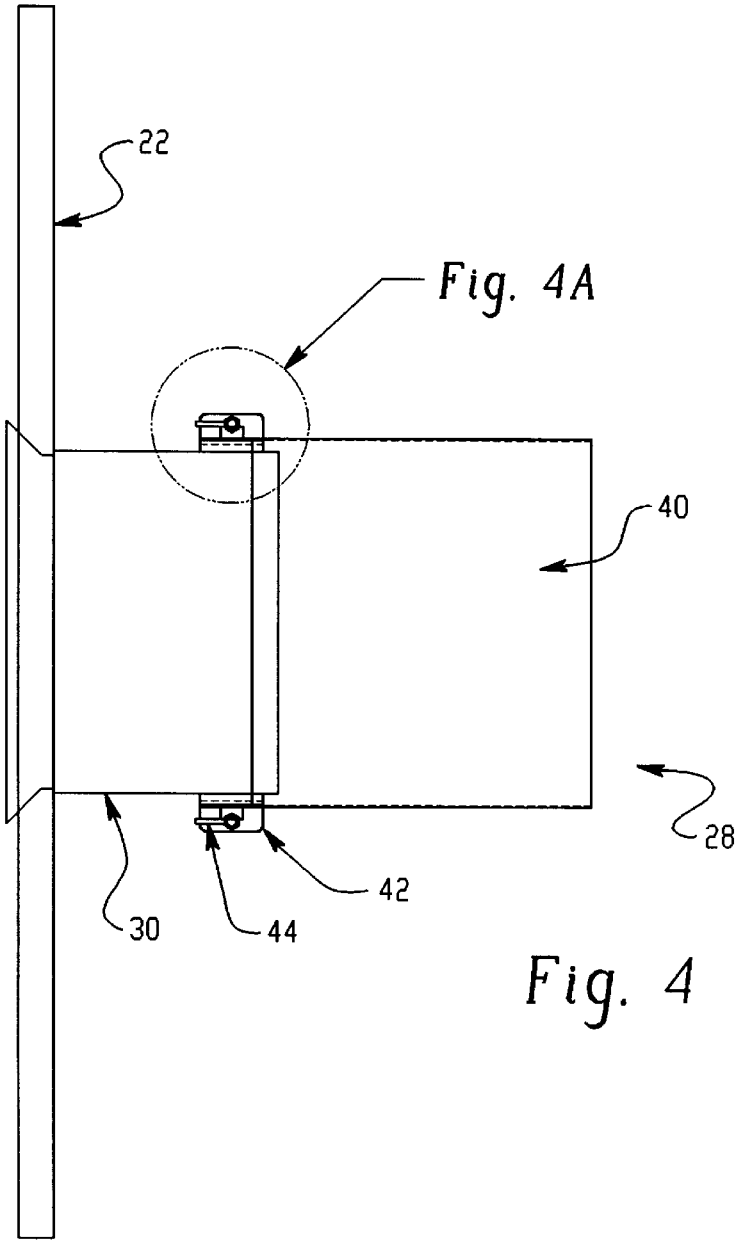
FIG. 4 is a top view of the outlet extension and adjacent portions of the machine, the outlet extension being shown in the first position.
Figure 4B:
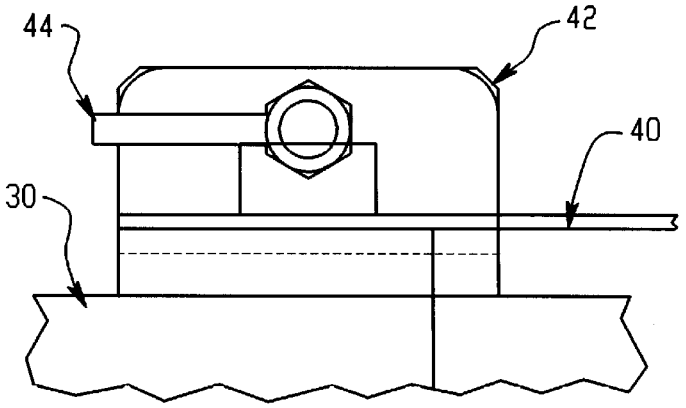
FIG. 4B is an enlarged top view of certain components located in the circled region denoted as FIG. 4A in FIG. 4.
Figure 6:
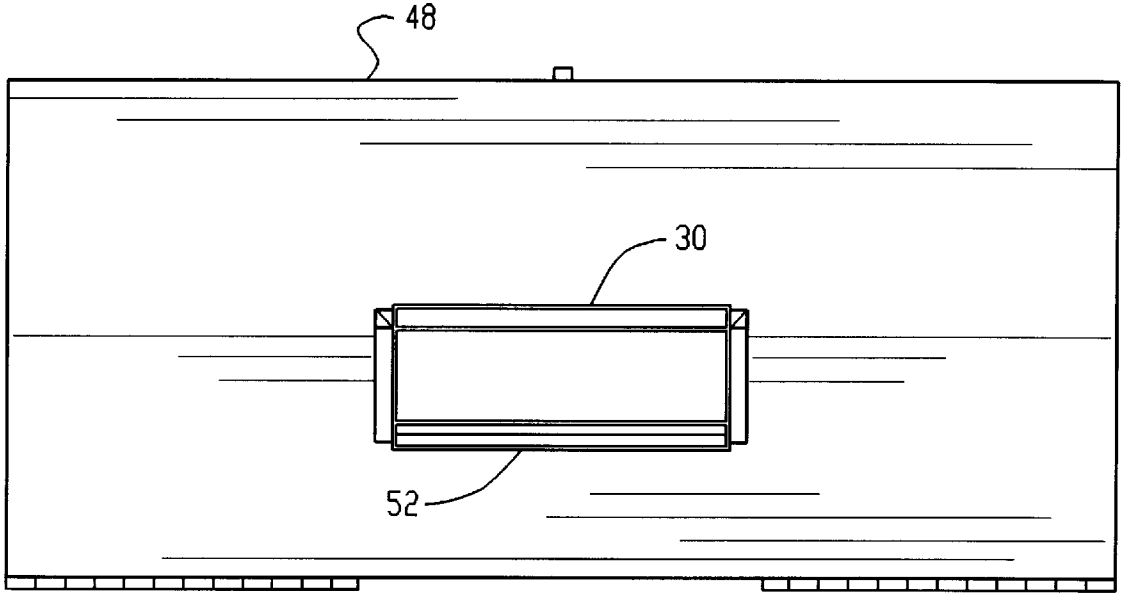
FIGS. 5 and 6 are isolated side and end views of the machine's outlet.
Figure 5:
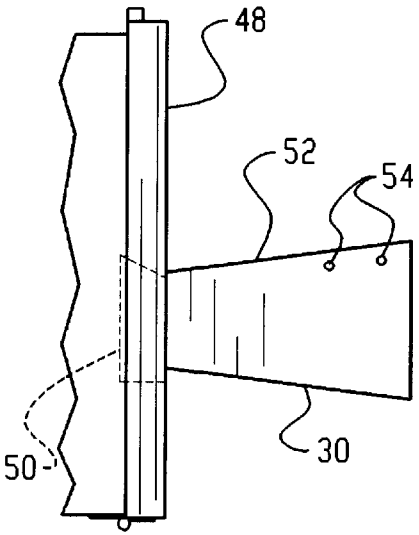
Figure 7:
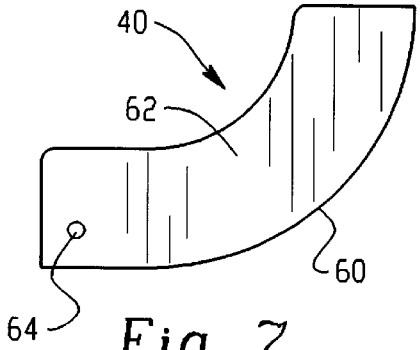
FIGS. 7, 8, and 9 are isolated side, end, and top views of the outlet extension.
Figure 8:
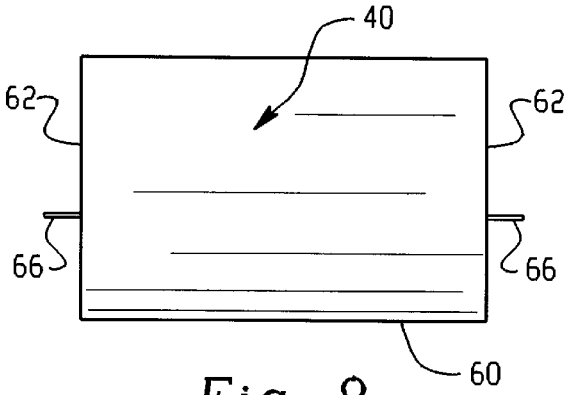
Figure 9:
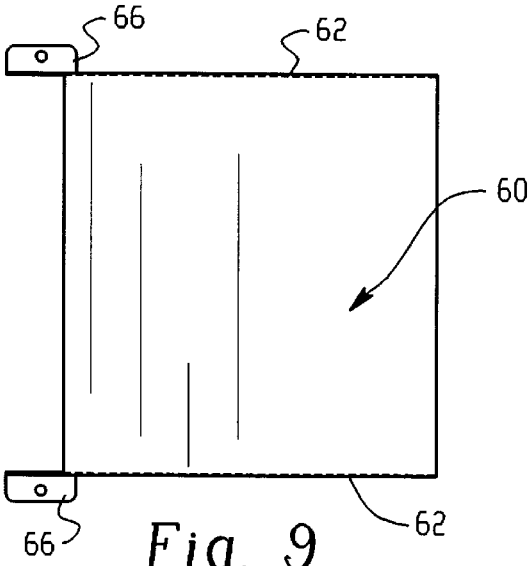
Figure 12:
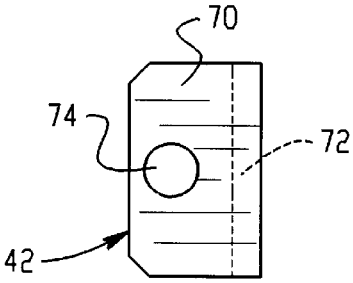
FIGS. 10, 11, and 12 are isolated side, front, and end views of a mounting member used to mount the outlet extension to the machine's outlet.
Figure 10:
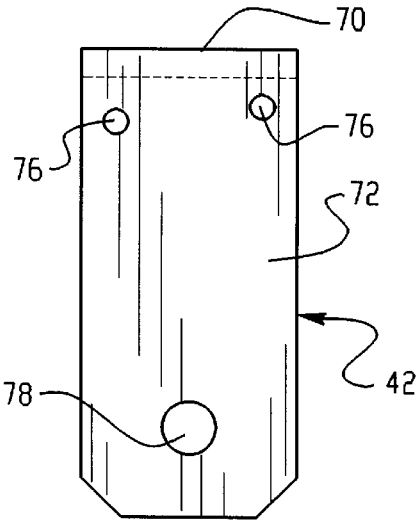
Figure 11:
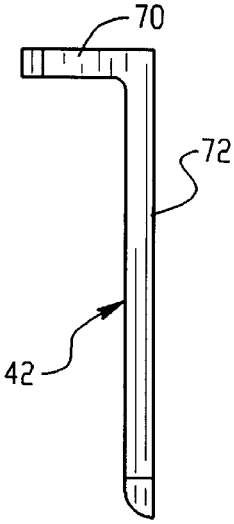

Turning now to FIGS. 3–12, the preferred outlet extension 28 and the machine outlet 30 (along with adjacent portions of the machine 22) are shown in detail. As is best seen in FIGS. 3 and 4, the outlet extension 28 includes a chute 40, a pair of brackets 42, and a pair of spring plungers 44. The brackets 42 and the spring plungers 44 coordinate to allow selective adjustment of the outlet extension 28 relative to the machine outlet 30. It should be noted that the present invention contemplates any coupling arrangement in which the outlet extension is coupled to the machine's outlet in such a manner as to allow for selective adjustment.

The preferred machine outlet 30 is mounted on a downstream end cover 48 which is hinged to the remaining portions of the machine 22. The outlet 30 is basically tunnel-shaped and includes an upstream converging portion 50 which tapers into a downstream rectangular (but slightly flaring) portion 52. The downstream portion 52 includes two bracket-mounting openings 54 on each side. (See FIGS. 5 and 6.) While the illustrated and preferred machine outlet includes the tunnel portions 50 and 52, it should be noted that such an arrangement is not necessary for the present invention. It is contemplated that the outlet extension 28 would be useful even if, for example, the outlet consisted simply of an opening in the end cover 48.

The chute 40 includes a bottom wall 60 and two side walls 62 which form a preferably open-topped passageway for the emerging cushioning products. In the illustrated embodiment, the walls 60 and 62 together form a relatively short upstream linear passageway which extends into a downstream curved passageway following an approximately 90° arc. However, other curved and/or straight passageways are possible with, and contemplated by the present invention. In any event, in the preferred chute 40, the side walls 62 each include a lower bracket-mounting opening 64 and each include an upper flange 66 with an opening for selective cooperation with one of the spring plungers 44. (See FIGS. 7, 8, and 9.)

The brackets 42 are each L-shaped in cross-section and include, in the illustrated orientation, a top horizontal wall 70 and a bottom vertical wall 72. The top wall 70 includes an opening 74 for mounting of one of the spring plungers 44. The bottom wall 72 includes a pair of upper bracket-mounting openings 76 and a lower chute-mounting opening 78. (See FIGS. 10, 11, and 12.)

In the preferred embodiment, the brackets 42 are attached to the machine outlet 30 via suitable coupling components (shown in FIGS. 3 and 4, but not specifically numbered) extending through the outlet openings 54 and the bracket openings 76. The curved chute 40 is pivotally coupled to the brackets 42 (and thus the machine outlet 30) via pivotable coupling components which extend through openings 78 in the brackets 42 and openings 64 in the chute 40. In one position (FIG. 3A), the spring plungers 44 (which are mounted within the bracket openings 74) extend through the openings in the chute flanges 66 to lock the chute 40 in the first upward position. In the second downward position (FIG. 3B), the chute 40 is released from the spring plungers 40, and rests in a downward position.

Although the illustrated outlet extension 28 is adjustable to two set positions, other arrangements are possible with, and contemplated by, the present invention. For example, with appropriate modifications, the outlet extension 28 could be adjusted to several positions to provide for a range of exit locations. Such a modification would be helpful when the cushioning products are directly removed from the outlet extension 28. Specifically, the range of adjustments could accommodate the various heights of different packaging personnel which may occur, for instance, during shift changes.

Figure 13:
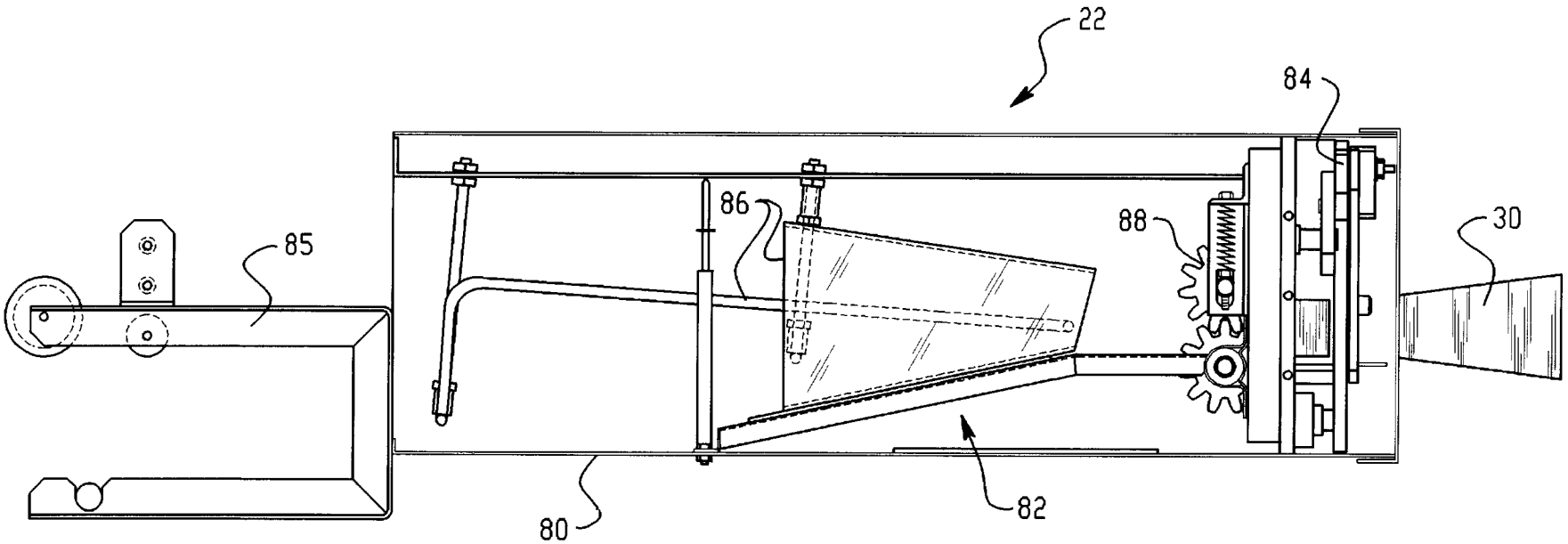
FIG. 13 is an side view of the cushioning conversion machine without the outlet extension, the machine being shown with a side panel removed to reveal its internal components.

Turning now to FIG. 13, the machine 22 is shown without the outlet extension 28 and with a side panel removed to reveal its internal components. The machine 22 includes a frame 80, a conversion assembly 82, a separating assembly 84, and a stock supply assembly 85, all these assemblies being mounted to the frame 80 in the preferred embodiment. The conversion assembly 82 converts the sheet-like stock material S into a three-dimensional strip of dunnage and the separating assembly 84 separates the strip of dunnage into cushioning products (or pads) of a desired length. As was indicated above, in the preferred embodiment, the machine 22 converts multiple plies of recyclable and reusable Kraft paper into a continuous strip of dunnage having two lateral pillow-like portions separated by a coined central band. However, the invention may be used in association with other forms of conversion assemblies. Consequently, the term "conversion assembly" is hereby defined as any assembly or any collection of assemblies (regardless of whether it is/they are structurally equivalent to the disclosed conversion assembly/assemblies) which converts a sheet-like stock material into a three-dimensional dunnage product.

The conversion assembly 82 includes a forming assembly 86 which is mounted to the frame 80. The forming assembly 86 includes a converging chute and a triangular shaped former which extends partway into the chute through the wider upstream end thereof. During the conversion process, the forming assembly 86 causes inward rolling of the lateral sides of the sheet-like stock material to form a continuous strip having two lateral pillow-like portions and a central band therebetween. Details of such a forming assembly are set forth in U.S. Pat. No. 4,750,896, which has already been incorporated by reference.

The conversion assembly 82 also includes a feed assembly 88 which is preferably mounted to the frame 80 downstream of the forming assembly 86. The feed assembly 88 advances the stock material through the forming assembly 86. In the illustrated embodiment, the feed assembly 88 is a pulling/connecting assembly which includes a pair of gears between which the stock material passes. Specifically, the feed assembly 88 performs a "pulling" function by drawing the continuous strip through the nip of the two cooperating and opposed gears thereby pulling the stock material through the forming assembly 86. Also, the feed assembly 88 performs a "connecting" function when the two opposing gears connect, or more particularly coin, the central band of the continuous strip as it passes therethrough. The preferred gears are disclosed in U.S. Pat. No. 4,968,291 which has already been incorporated by reference.

The separating assembly 84 is preferably a cutting assembly which cuts the strip into sections of a desired length and which is positioned downstream of the forming assembly 86 and the feed assembly 88. The preferred separating (cutting) assembly 84 is disclosed in detail in co-owned and co-pending U.S. application Ser. No. 08/188,305 to Simmons, entitled "Cushioning Conversion Machine Including a Cutting/Aligning Assembly", the entire disclosure of which is hereby incorporated by reference. The preferred machine outlet 30 preferably acts as a post-cutting constraining assembly, such as the one disclosed in U.S. Pat. No. 5,322,477, the entire disclosure of which has already been incorporated by reference.

The stock material is supplied to the forming assembly 86 by the stock supply assembly 85 which is positioned upstream of the forming assembly 86. The illustrated stock supply assembly 85 is mounted to the machine's frame 80 and includes two lateral spaced brackets which are generally shaped like a sideways "U". The lower legs of the brackets include slots which, when rolled stock material is used with the machine 22, cradle a supply rod extending through the core of the stock roll. The upper legs of the brackets cooperate to mount a sheet separator and a constant-entry bar. Further details of a suitable stock supply assembly are set forth in co-owned U.S. Pat. No. 4,750,896, which has already been incorporated by reference.

One may now appreciate that the present invention provides a cushioning conversion machine in which an outlet extension is coupled to the machine's outlet in such a manner that is selectively adjustable relative to the outlet to provide a plurality of exit locations for the cushioning products. Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A cushioning conversion machine for converting a sheet stock material into cushioning products, said machine comprising:

a frame including an upstream end and a downstream end;

a conversion assembly, mounted to the frame, which converts such sheet stock material into a three-dimensional strip of dunnage;

a stock supply assembly, positioned upstream of the conversion assembly, which supplies the sheet stock material to the conversion assembly;

a separating assembly, positioned downstream of the conversion assembly, which separates the strip of dunnage into cushioning products of a desired length;

an outlet guide, mounted with respect to the frame downstream of the separating assembly, through which the cushioning products emerge; and an outlet extension, positioned downstream of the outlet guide, which forms a continuous passageway for the cushioning products from the outlet guide to an exit location, the outlet extension being coupled to the outlet guide in such a manner that it is selectively adjustable relative to the outlet guide to provide for a plurality of exit locations for the cushioning products.

2. A cushioning conversion machine as set forth in claim 1 wherein the outlet extension is pivotally coupled to the outlet guide.

3. A cushioning conversion machine as set forth in claim 1 wherein the outlet extension is selectively adjustable between a first upward position and a second downward position.

4. A cushioning conversion machine as set forth in any of claims 1–3 wherein the outlet extension comprises a chute and coupling components which couple the chute to the machine's outlet guide.

5. A cushioning conversion machine as set forth in claim 4 wherein the chute is curved.

6. A cushioning conversion machine as set forth in claim 1 wherein the machine's outlet guide comprises a tunnel-shaped member.

7. A cushioning conversion machine as set forth in claim 1 wherein the conversion assembly includes:

a forming assembly which forms the sheet stock material into the three-dimensional strip of dunnage; and a feed assembly which advances the sheet stock material through the forming assembly.

8. A cushioning conversion machine as set forth in claim 7 wherein the feed assembly is mounted to the frame downstream of the forming assembly and pulls the stock material through the forming assembly.

9. A cushioning conversion machine as set forth in claim 8 wherein the feed assembly also connects the continuous strip of dunnage.

10. A cushioning conversion machine as set forth in claim 9 wherein the feed assembly comprises a pair of gears.

11. A cushioning conversion machine as set forth in claim 1 wherein the separating assembly comprises a cutting assembly which cuts the strip of dunnage into sections of a desired length.

12. A cushioning conversion machine as set forth in claim 11 wherein the cutting assembly is mounted to the machine's frame.

13. A cushioning conversion machine as set forth in claim 12 wherein the stock supply assembly is mounted to the machine's frame.

14. A method of making cushioning products, said method comprising the steps of:

providing a sheet stock material;

adjusting an outlet extension of a cushioning conversion machine to provide for one of a plurality exit locations for the cushioning products, the cushioning conversion machine also comprising a frame including an upstream end and a downstream end, a conversion assembly, mounted to the frame, which converts the stock material into a three-dimensional strip of dunnage, a stock supply assembly, positioned upstream of the conversion assembly, which supplies the sheet stock material to the conversion assembly, a separating assembly, positioned downstream of the conversion assembly, which separates the strip of dunnage into cushioning products of a desired length, and an outlet guide, positioned downstream of the separating assembly, through which the cushioning products emerge, wherein an outlet extension is mounted with respect to the frame downstream of the outlet guide, forms a continuous passageway for the cushioning products from the outlet guide to an exit location, and is coupled to the outlet guide in such a manner that it is selectively adjustable relative to the outlet guide to provide for the plurality of exit locations for the cushioning products;

using the cushioning conversion machine to convert the stock material into the cushioning products which are exited to the one exit location;

readjusting the outlet extension to another one of the plurality of exit locations; and using the cushioning conversion machine to convert the stock material into the cushioning products which are exited at the other exit location.

15. A method as set forth in claim 14 wherein said step of providing the sheet stock material comprises providing sheet stock material that is biodegradable, recyclable, and reusable.

16. A method as set forth in claim 15 wherein said step of providing the sheet stock material comprises the step of providing sheet stock material that is Kraft paper.

17. A method as set forth in claim 16 wherein said step of providing the sheet stock material comprises the step of providing sheet stock material that comprises multiple plies of Kraft paper.

18. A method as set forth in claim 17 wherein said step of providing sheet stock material comprises the step of providing sheet-like stock material that comprises a roll of three superimposed plies of Kraft paper.

19. A cushioning conversion machine for converting stock material into cushioning products, said machine comprising:

a conversion assembly which converts the stock material into cushioning products;

an outlet guide, positioned downstream of the conversion assembly, through which the cushioning products emerge; and an outlet extension, positioned downstream of the outlet guide, which forms a continuous passageway for the cushioning products from the outlet guide to an exit location, the outlet extension being mounted to the outlet guide in such a manner that it is selectively adjustable relative to the outlet guide to provide for a plurality of exit locations for the cushioning products.

20. A method of making cushioning products, said method comprising the steps of:

supplying a stock material to a cushioning conversion machine comprising a conversion assembly which converts the stock material into cushioning products, an outlet guide, positioned downstream of the conversion assembly, through which the cushioning products emerge, and a cushioning conversion machine outlet extension, positioned downstream of the outlet guide, which forms a continuous passageway for the cushioning products from the outlet guide to an exit location, the outlet extension being mounted to the outlet guide in such a manner that it is selectively adjustable relative to the outlet guide to provide for a plurality of exit locations for the cushioning products;

adjusting the outlet extension to one of the plurality exit locations for the cushioning products;

using the cushioning conversion machine to convert the stock material into cushioning products which emerge through the outlet guide and which pass through the outlet extension to said one of the plurality of exit locations;

readjusting the outlet extension to another one of the plurality of exit locations for the cushioning products; and using the cushioning conversion machine to convert the stock material into cushioning products which emerge through the outlet guide and which pass through the outlet extension to said other one of the plurality of exit locations.

* * * * *